US008157261B2

(12) United States Patent
Oota et al.

(10) Patent No.: US 8,157,261 B2
(45) Date of Patent: Apr. 17, 2012

(54) PAPER SHEET CONVEYING DEVICE AND PAPER SHEET CONVEYING SYSTEM

(75) Inventors: Ryuichi Oota, Kinokawa (JP); Hideki Oiwa, Kinokawa (JP); Masasuke Funase, Kinokawa (JP); Takaaki Maeda, Kinokawa (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 0 days.

(21) Appl. No.: 12/993,489

(22) PCT Filed: Mar. 3, 2009

(86) PCT No.: PCT/JP2009/053954

§ 371 (c)(1),
(2), (4) Date: Nov. 19, 2010

(87) PCT Pub. No.: WO2009/142042

PCT Pub. Date: Nov. 26, 2009

(65) Prior Publication Data

US 2011/0074091 A1 Mar. 31, 2011

(30) Foreign Application Priority Data

May 22, 2008 (JP) ..... 2008-134141

(51) Int. Cl.
*B65H 5/34* (2006.01)

(52) U.S. Cl. ..... 271/270; 271/265.01; 271/176; 271/272; 271/314

(58) Field of Classification Search ..... 271/270, 271/265.01, 176, 314, 272, 225, 184
See application file for complete search history.

(56) References Cited

U.S. PATENT DOCUMENTS

| | | | | |
|---|---|---|---|---|
| 6,687,569 | B1 * | 2/2004 | Skinger et al. | 700/220 |
| 6,687,570 | B1 * | 2/2004 | Sussmeier et al. | 700/220 |
| 6,792,332 | B1 * | 9/2004 | DePoi | 700/213 |
| 2007/0194522 | A1 * | 8/2007 | Cheng et al. | 271/272 |
| 2008/0073833 | A1 | 3/2008 | Ono et al. | |

FOREIGN PATENT DOCUMENTS

| | | | |
|---|---|---|---|
| JP | 2001-232700 | A | 8/2001 |
| JP | 2005-59991 | A | 3/2005 |
| JP | 2005-75569 | A | 3/2005 |
| JP | 2008-81251 | A | 4/2008 |

OTHER PUBLICATIONS

International Search Report (PCT/ISA/210) dated May 19, 2009.
Written Opinion (PCT/ISA/237) dated May 19, 2009.

* cited by examiner

*Primary Examiner* — David H Bollinger
(74) *Attorney, Agent, or Firm* — Buchanan Ingersoll & Rooney PC

(57) ABSTRACT

A paper sheet conveying device is equipped with a conveying path (2) formed of conveying roller pairs and a controlling section conveying rollers. The conveying path (2) is composed of a first-half conveying path (2A) and a last-half conveying path (2B). The first-half conveying path (2A) has a first-half driving mechanism for controlling the rotational speed of the lower conveying rollers and a first-half vertically moving mechanism for vertically moving the upper conveying rollers. The last-half conveying path (2B) has a last-half driving mechanism for controlling the rotational speed of the lower conveying rollers and a last-half vertically moving mechanism for vertically moving the upper conveying rollers. The controlling section is configured so as to control the first-half driving mechanism, the first-half vertically moving mechanism, the last-half driving mechanism and the last-half vertically moving mechanism depending on the position of the paper sheet being conveyed.

9 Claims, 13 Drawing Sheets

PAPER SHEET CONVEYING DEVICE AND PAPER SHEET CONVEYING SYSTEM

TECHNICAL FIELD

The present invention relates to a paper sheet conveying device for conveying a paper sheet delivered from a pre-processing device to a post-processing device, and to a paper sheet conveying system equipped with the paper sheet conveying device.

BACKGROUND ART

In the case that a paper sheet is subjected to a cutting process, a creasing process, a perforating process, etc. while being conveyed and then further subjected to a folding process, a continuous processing device integrally and continuously equipped with processing sections for performing these processes is used, or independent processing devices equipped with the respective processing sections independently are used in combination.

Patent document 1: Japanese Patent Application Laid-open Publication No. 2001-232700

DISCLOSURE OF INVENTION

Problem to be Solved by the Invention

In the case that such a continuous processing device is used, the following problems occur.

(1) Since the continuous processing device is very large in size, it requires a large installation space.

(2) Since the layout of the processing sections inside the device cannot be changed, the distance from the paper supply position to the paper ejection position thereof cannot be changed, whereby the conveying distance becomes longer more than necessary and the operation efficiency becomes low.

On the other hand, in the case that such individual processing devices are used, the following problems occur.

(1) Since only the devices necessary for the processes to be performed should only be used, the installation space thereof may be small; however, since it is necessary to displace paper sheets among the devices, this takes time and effort.

(2) In the case that the devices are connected to eliminate the above-mentioned time and effort, it is necessary to adjust the conveying speeds among the devices and to make adjustments so that the conveying paths are aligned among the devices, and this is troublesome.

The present invention is intended to provide a paper sheet conveying device and a paper sheet conveying system capable of solving the above-mentioned problems.

Means for Solving Problem

A first aspect of the present application is a paper sheet conveying device for conveying a paper sheet delivered from a pre-processing device to a post-processing device, equipped with a conveying path formed of a large number of conveying roller pairs arranged in parallel, each pair consisting of upper and lower conveying rollers for conveying a paper sheet held therebetween, and a controlling section for detecting the position of the paper sheet being conveyed and controlling the operation of the conveying rollers, wherein the conveying path is composed of a first-half conveying path formed of a plurality of integrally operating conveying roller pairs and a last-half conveying path formed of a plurality of integrally operating conveying roller pairs; the first-half conveying path has a first-half driving mechanism for controlling the rotational speed of the lower conveying rollers of the conveying roller pairs and a first-half vertically moving mechanism for vertically moving the upper conveying rollers of the conveying roller pairs; the last-half conveying path has a last-half driving mechanism for controlling the rotational speed of the lower conveying rollers of the conveying roller pairs and a last-half vertically moving mechanism for vertically moving the upper conveying rollers of the conveying roller pairs; and the controlling section is configured so as to control the first-half driving mechanism, the first-half vertically moving mechanism, the last-half driving mechanism and the last-half vertically moving mechanism depending on the position of the paper sheet being conveyed.

The controlling section is configured, for example, so as to perform control as described below. More specifically, the controlling section controls the first-half vertically moving mechanism and the last-half vertically moving mechanism so as to move the upper conveying rollers of the first-half conveying path and the last-half conveying path upward when the trailing end of a paper sheet being delivered from the pre-processing device is within the pre-processing device; controls at least the first-half driving mechanism so that the rotational speed of at least the lower conveying rollers of the first-half conveying path becomes equal to the conveying speed of the pre-processing device; controls the first-half vertically moving mechanism and the last-half vertically moving mechanism so as to move the upper conveying rollers of the first-half conveying path and the last-half conveying path downward at the time when the trailing end of the paper sheet is approximately moved away from the pre-processing device; and controls the first-half driving mechanism and the last-half driving mechanism so that the rotational speed of the lower conveying rollers of the first-half conveying path and the last-half conveying path becomes equal to the conveying speed of the post-processing device.

A second aspect of the present application is a paper sheet conveying system in which a pre-processing device for performing a cutting process and/or a creasing process for a paper sheet while conveying the paper sheet, the above-mentioned paper sheet conveying device and a post-processing device for performing a folding process for the paper sheet while conveying the paper sheet are connected in this order.

EFFECT OF THE INVENTION

With the above-mentioned first aspect of the present invention, since a paper sheet can be received in synchronization with the conveying speed of the pre-processing device and can be delivered in synchronization with the conveying speed of the post-processing device, the pre-processing device and the post-processing device can be connected so that both the devices can smoothly perform processing.

With the above-mentioned second aspect of the present invention, since it is possible to construct the paper sheet conveying system capable of allowing the post-processing device to perform processing without halting the processing of the pre-processing device, the working efficiency thereof can be improved.

EXPLANATIONS OF REFERENCE NUMERALS

1: paper sheet conveying device, 10, 10A, 10B: paper sheet conveying systems, 100: paper sheet, 2: conveying path, 21, 22, 23, 24, 25, 26, 27, 28: conveying roller pairs, 211, 221, 231, 241, 251, 261, 271, 281: lower conveying rollers, 212, 222, 232, 242, 252, 262, 272, 282: upper conveying rollers, 2A: first-half conveying path, 2B: last-half conveying path, 3: first-half driving mechanism, 4: last-half driving mechanism, 5: first-half vertically moving mechanism, 8: cross conveying device, 82: conveying path, 91: pre-processing device, 92: post-processing device, S1, S2, S3: sensors

BEST MODE FOR CARRYING OUT THE INVENTION

An Embodiment of a Paper Sheet Conveying Device

Figure 1:
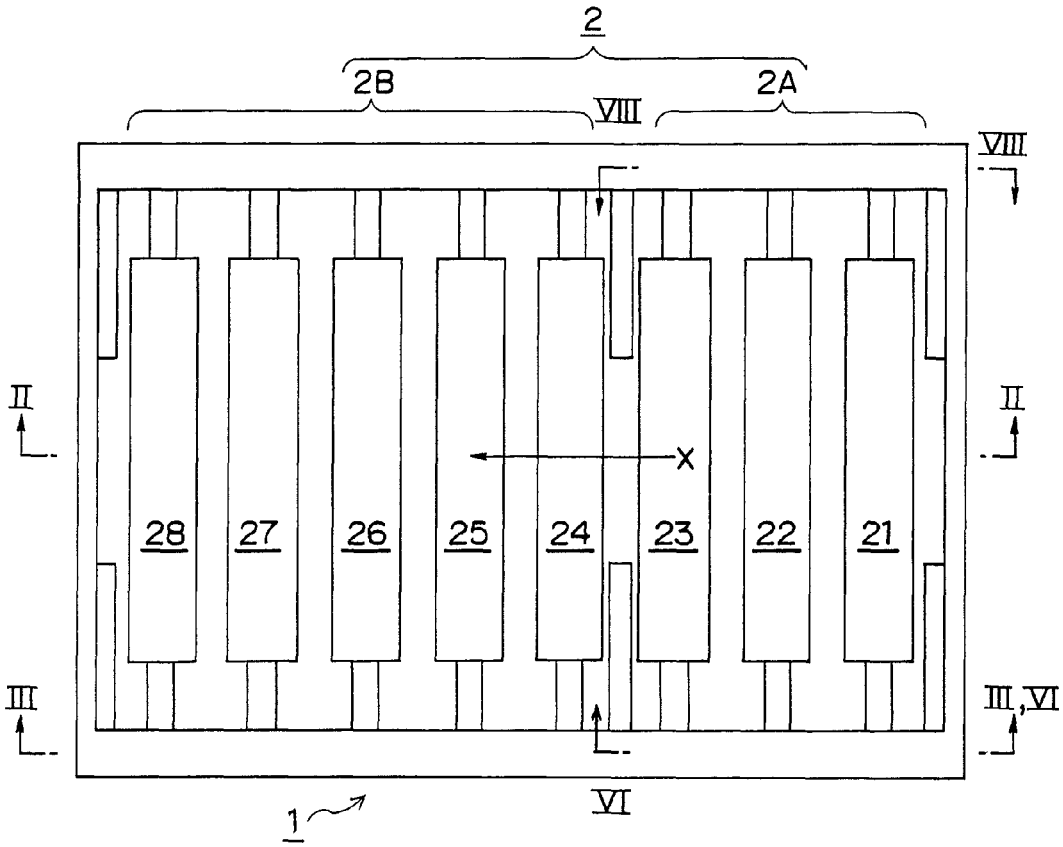
FIG. 1 is a plan view showing a paper sheet conveying device according to an embodiment of the present invention.
Figure 2:
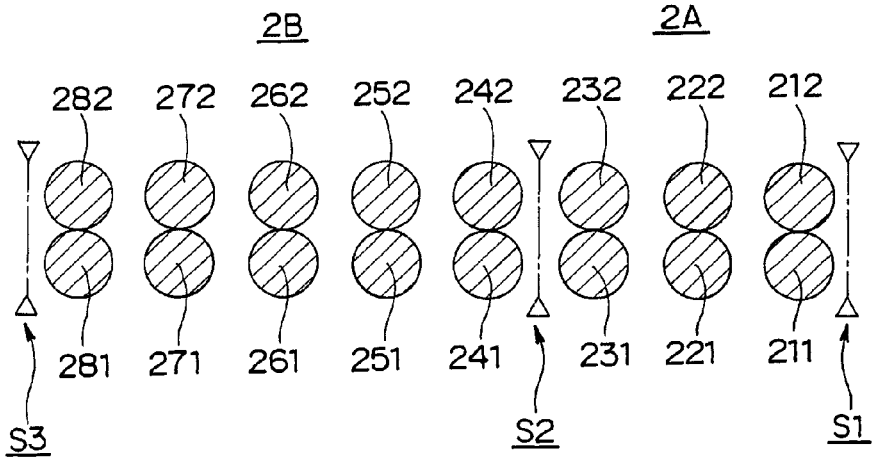
FIG. 2 is a schematic sectional view taken on line II-II of FIG. 1.

FIG. 1 is a plan view showing a paper sheet conveying device according to an embodiment of the present invention, and FIG. 2 is a schematic sectional view taken on line II-II of FIG. 1. This paper sheet conveying device 1 is a device for conveying a paper sheet delivered from a pre-processing device (not shown) to a post-processing device (not shown). The conveying direction is an arrow X direction.

This device 1 is equipped with a conveying path 2 and a controlling section (not shown). The conveying path 2 is formed of a large number of conveying roller pairs arranged in parallel, each pair consisting of upper and lower conveying rollers for conveying a paper sheet held therebetween, and the conveying path 2 is herein formed of eight conveying roller pairs 21 to 28. Furthermore, the conveying path 2 is formed of a first-half conveying path 2A consisting of three conveying roller pairs 21, 22 and 23 on the upstream side of the conveying direction and a last-half conveying path 2B consisting of five conveying roller pairs 24, 25, 26, 27 and 28 on the downstream side of the conveying direction.

Figure 3:
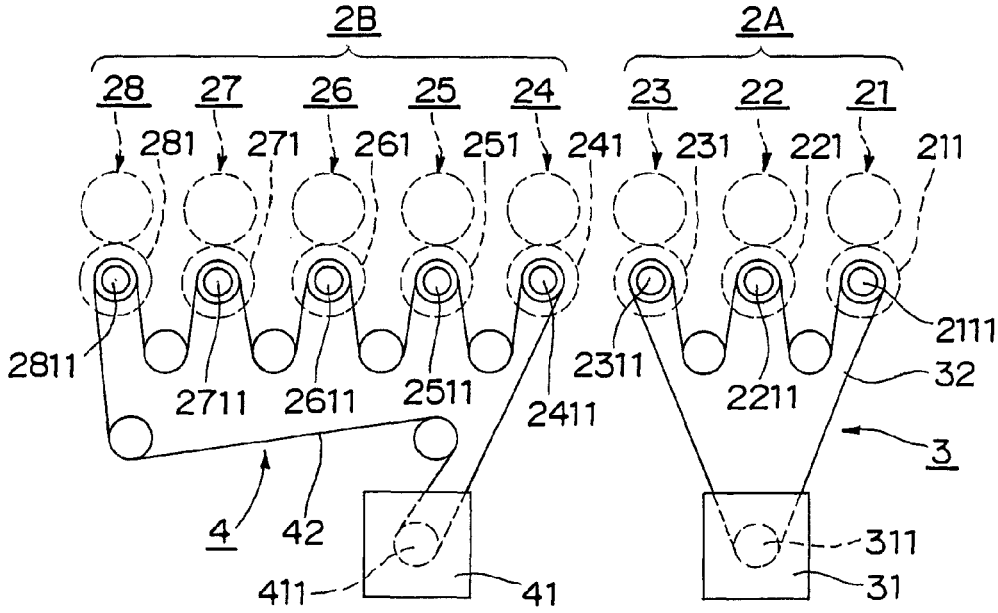
FIG. 3 is a sectional view taken on line III-III of FIG. 1.

As shown in FIG. 3, a sectional view taken on line III-III of FIG. 1, the first-half conveying path 2A has a first-half driving mechanism 3 for controlling the rotational speed of the lower conveying rollers 211, 221 and 231 of the conveying roller pairs 21, 22 and 23. In addition, the last-half conveying path 2B has a last-half driving mechanism 4 for controlling the rotational speed of the lower conveying rollers 241, 251, 261, 271 and 281 of the conveying roller pairs 24, 25, 26, 27 and 28. More specifically, the first-half driving mechanism 3 is equipped with a drive motor 31 and a belt 32, and the belt 32 is stretched between the output shaft 311 of the drive motor 31 and the rotation shafts 2111, 2211 and 2311 of the lower conveying rollers 211, 221 and 231. Furthermore, the last-half driving mechanism 4 is equipped with a drive motor 41 and a belt 42, and the belt 42 is stretched between the output shaft 411 of the drive motor 41 and the rotation shafts 2411, 2511, 2611, 2711 and 2811 of the lower conveying rollers 241, 251, 261, 271 and 281.

Figure 4:
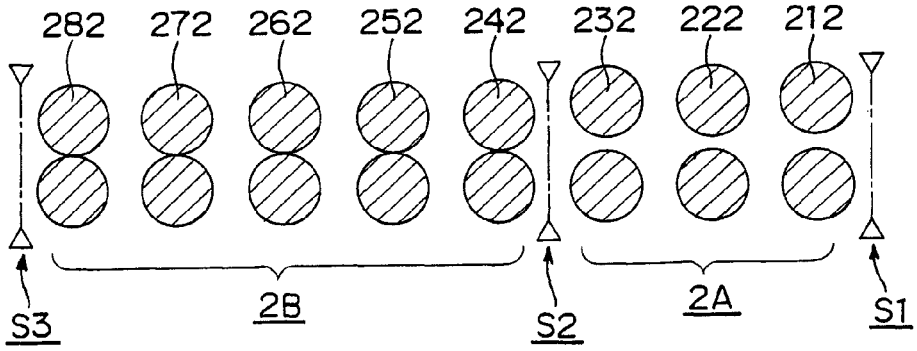
FIG. 4 is a view showing the operation of the upper conveying rollers of a first-half conveying path, corresponding to FIG. 2.
Figure 5:
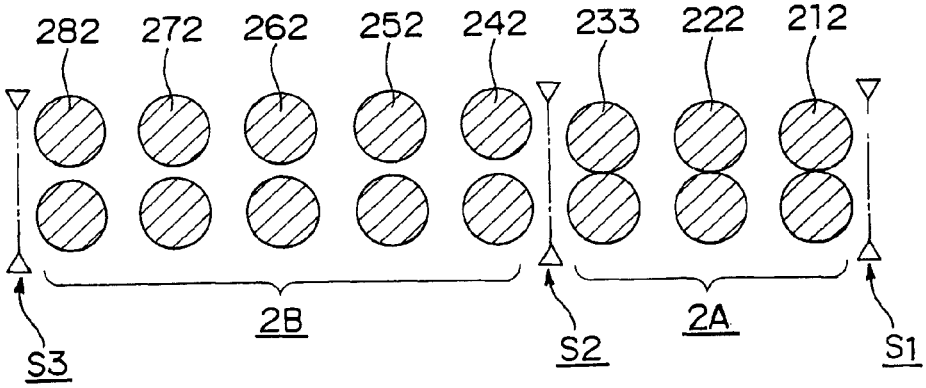
FIG. 5 is a view showing the operation of the upper conveying rollers of a last-half conveying path, corresponding to FIG. 2.

Furthermore, the first-half conveying path 2A has a first-half vertically moving mechanism 5 (described later) for integrally vertically moving the upper conveying rollers 212, 222 and 232 of the conveying roller pairs 21, 22 and 23 as shown in FIG. 4. In addition, the last-half conveying path 2B has a last-half vertically moving mechanism for integrally vertically moving the upper conveying rollers 242, 252, 262, 272 and 282 of the conveying roller pairs 24, 25, 26, 27 and 28 as shown in FIG. 5.

Figure 6:
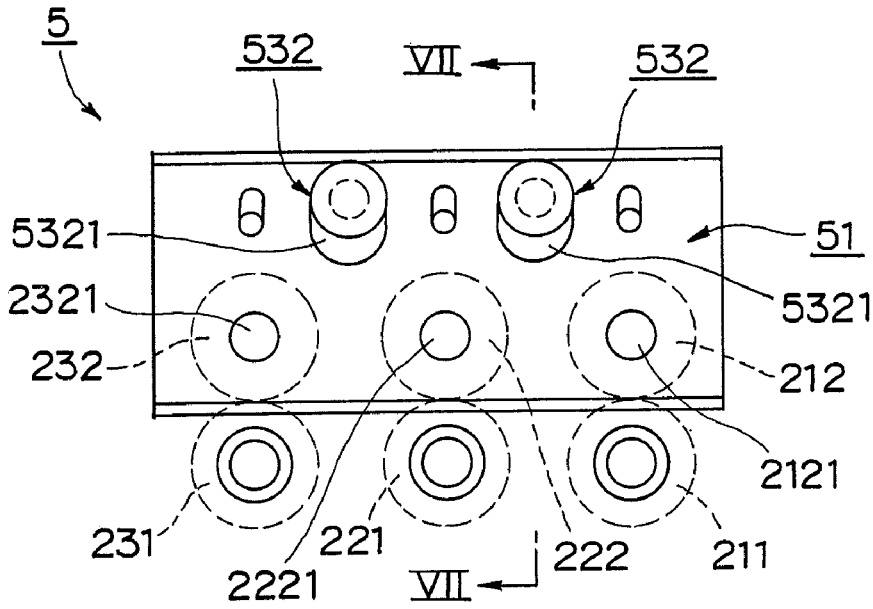
FIG. 6 is a sectional view taken on line VI-VI of FIG. 1.
Figure 7:
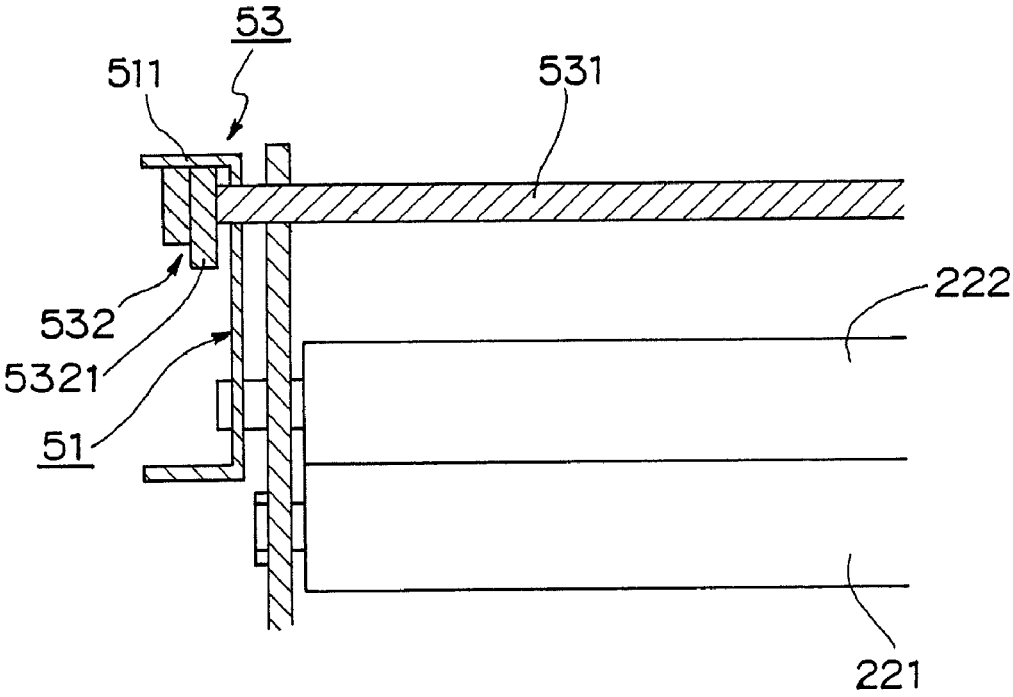
FIG. 7 is a sectional view taken on line VII-VII of FIG. 6.
Figure 8:
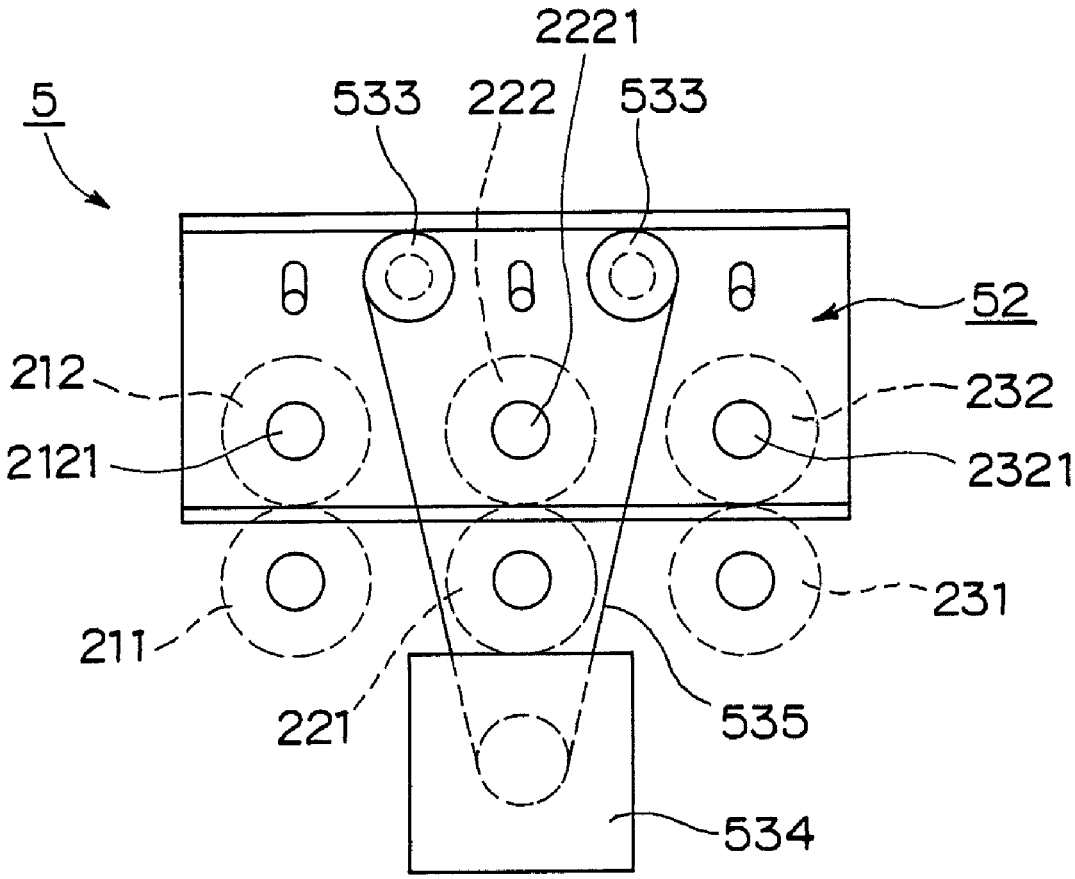
FIG. 8 is a sectional view taken on line VIII-VIII of FIG. 1.
Figure 9:
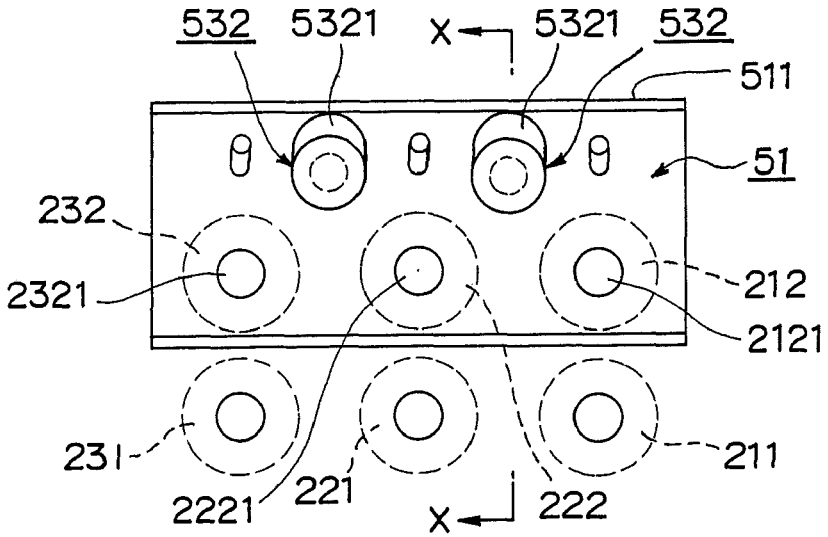
FIG. 9 is a view corresponding to FIG. 6.
Figure 10:
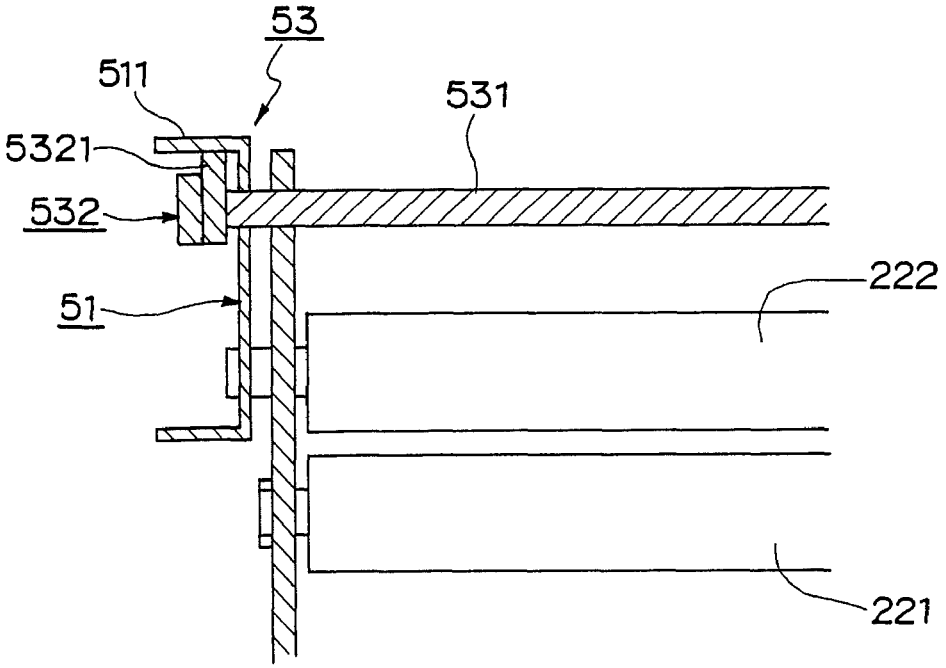
FIG. 10 is a sectional view taken on line X-X of FIG. 9.

FIGS. 6 to 10 show the first-half vertically moving mechanism 5. FIG. 6 is a sectional view taken on line VI-VI of FIG. 1, indicating the inside of the first-half conveying path 2A on one side face thereof. FIG. 8 is a sectional view taken on line VIII-VIII of FIG. 1, indicating the inside of the first-half conveying path 2A on the other side face thereof. The rotation shafts 2121, 2221 and 2321 of the three upper conveying rollers 212, 222 and 232 of the first-half conveying path 2A are rotatably supported on a movable vertical plate 51 at one ends thereof and on a movable vertical plate 52 at the other ends thereof as shown in FIGS. 6 and 8. FIG. 7 is a sectional view taken on line VII-VII of FIG. 6. In addition, cam mechanisms 53 are provided across the two vertical plates 51 and 52. Each cam mechanism 53 is equipped with a rotation shaft 531, a cam plate 532 secured to one end of the rotation shaft 531, and a pulley 533 secured to the other end of the rotation shaft 531. The cam mechanisms 53, two in number, are provided in parallel, with a space therebetween. The pulleys 533 are adapted to be rotated by a drive motor 534 via a belt 535. The cam plate 532 has a protruding portion 5321. In the state shown in FIG. 6 in which the upper conveying rollers 212, 222 and 232 make contact with the lower conveying rollers 211, 221 and 231, the protruding portions 5321 are positioned on the lower side. In the state shown in FIG. 6, when the pulleys 533 are rotated by the drive motor 534, the cam plates 532 are rotated, and the protruding portions 5321 make contact with the upper flange 511 of the vertical plate 51 and are positioned on the upper side, as shown in FIG. 9 and FIG. 10, a sectional view taken on line X-X of FIG. 9, whereby the vertical plate 51 is moved upward together with the vertical plate 52, and the upper conveying rollers 212, 222 and 232 are separated from the lower conveying rollers 211, 221 and 231. In the state shown in FIG. 9, when the pulleys 533 are rotated further by the drive motor 534, the cam plates 532 are rotated, and the protruding portions 5321 are positioned on the lower side, whereby the vertical plate 51 is moved downward together with the vertical plate 52, and the upper conveying rollers 212, 222 and 232 make contact with the lower conveying rollers 211, 221 and 231. Hence, the first-half vertically moving mechanism 5 integrally vertically moves the upper conveying rollers 212, 222 and 232, thereby being capable of making contact with and separating from the lower conveying rollers 211, 221 and 231.

The last-half vertically moving mechanism also has a configuration similar to that of the first-half vertically moving mechanism 5.

The controlling section is equipped with a sensor S1 at the leading end of the first-half conveying path 2A, a sensor S2 between the first-half conveying path 2A and the last-half conveying path 2B, and a sensor S3 at the trailing end of the last-half conveying path 2B to detect the position of a paper sheet being conveyed, as shown in FIG. 2. Each sensor is formed of a pair of transmission sensors. Furthermore, the controlling section is configured so as to control the first-half driving mechanism 3, the first-half vertically moving mechanism 5, the last-half driving mechanism 4 and the last-half vertically moving mechanism depending on the position of the paper sheet detected by the sensors S1, S2 and S3.

[An Embodiment of a Paper Sheet Conveying System]

Figure 11:
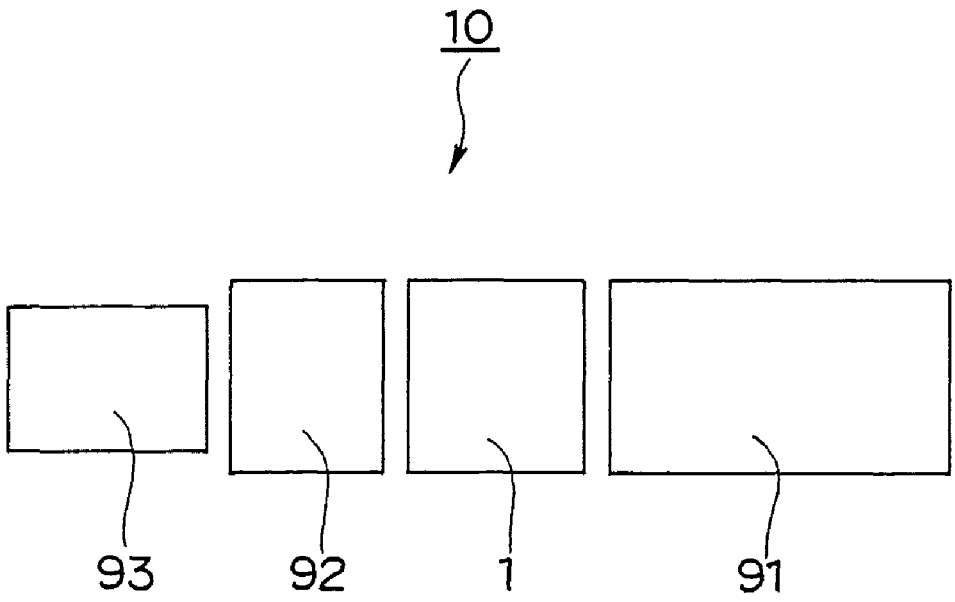
FIG. 11 is a plan view showing the configuration of a paper sheet conveying system according to the embodiment of the present invention.

The device 1 having the above-mentioned configuration is used to configure such a paper sheet conveying system 10 as shown in FIG. 11, for example. In this system, the device 1 is disposed between a pre-processing device 91 for continuously performing a plurality of processes, such as a cutting process, for a paper sheet while conveying the paper sheet and a post-processing device 92 for performing a folding process for the paper sheet subjected to the cutting process, etc. A stacker device 93 for stacking the paper sheet is disposed on the downstream side of the post-processing device 92 in the conveying direction. In the system 10, the conveying speed (processing speed) V1 of the pre-processing device 91 is different from the conveying speed (processing speed) V2 of the post-processing device 92, that is, V2>V1.

[Operation of the Above-Mentioned Embodiment]

Next, the operation of the above-mentioned device 1 in the above-mentioned system 10 will be described. The operation has some patterns depending on the length of a paper sheet, and the controlling section performs control depending on the patterns. In the above-mentioned system 10, a sensor S0 (see FIGS. 12 to 15) is disposed at the trailing end of the pre-processing device 91 to detect the position of a paper sheet being delivered from the pre-processing device 91, and a sensor S4 (see FIGS. 12 to 15) is disposed at the trailing end of the loading path 2C of the post-processing device 92 to detect the position of a paper sheet being loaded into the post-processing device 92. In this case, the controlling section of the above-mentioned device 1 is configured so as to control the first-half driving mechanism 3, the first-half vertically moving mechanism 5, the last-half driving mechanism 4 and the last-half vertically moving mechanism depending on the position of the paper sheet detected by the sensors S0, S1, S2, S3 and S4. Each of the sensors S0 and S4 is also formed of a pair of transmission sensors. In addition, the rotational speed of the lower conveying rollers 291 of the loading path 2C of the post-processing device 92 is also controlled by the same mechanism as that of the first-half driving mechanism 3 of the first-half conveying path 2A or the last-half driving mechanism 4 of the last-half conveying path 2B.

In the following descriptions, the distance between the sensor S0 and the sensor S1 is represented by L0, the distance between the sensor S1 and the sensor S2 is represented by L1, the distance between the sensor S2 and the sensor S3 is represented by L2, and the distance between the sensor S3 and the sensor S4 is represented by L3.

(First Pattern)

Figure 12:
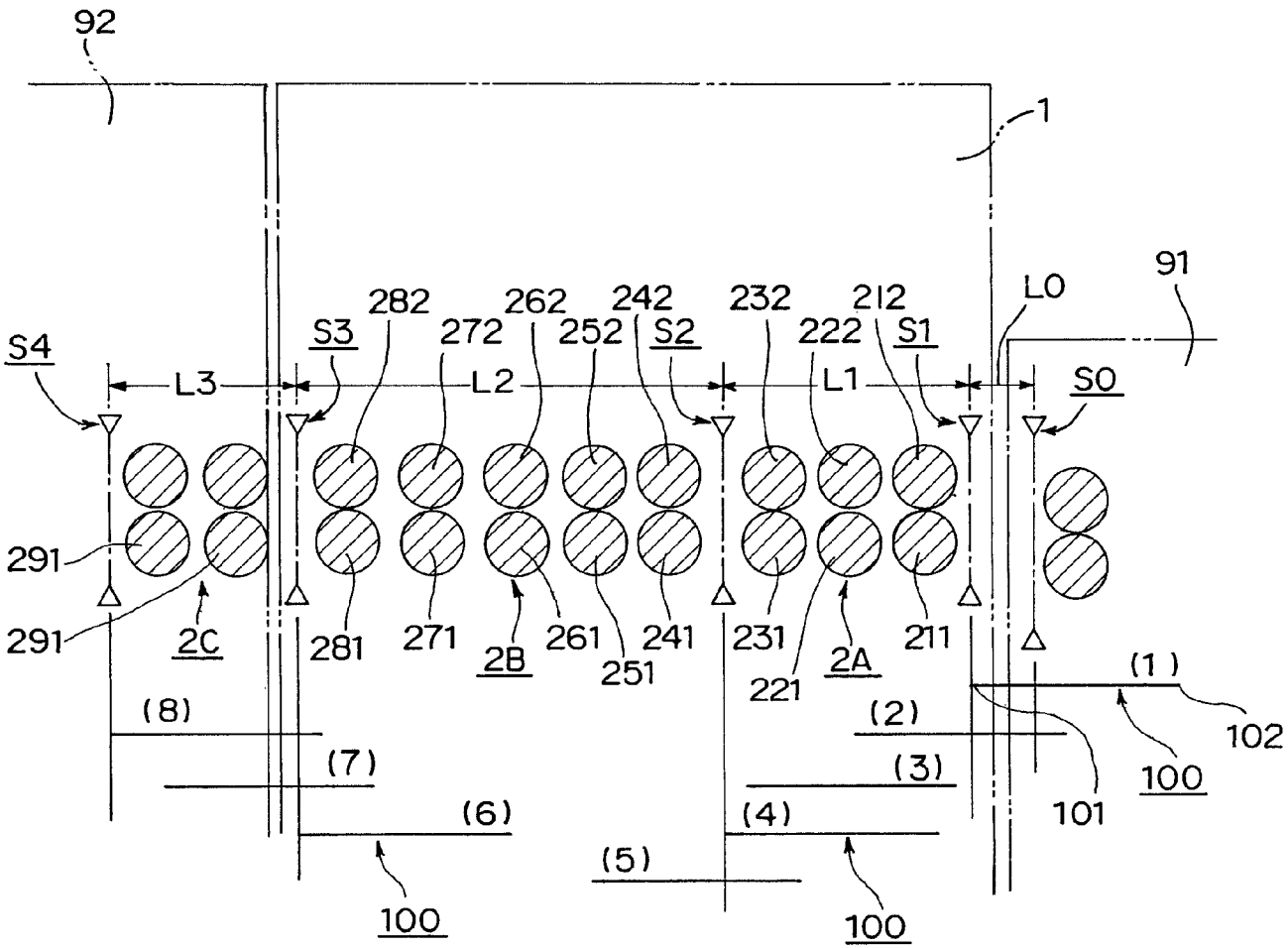
FIG. 12 is a schematic sectional view showing a first pattern of paper sheet conveyance in the system shown in FIG. 11.

FIG. 12 is a schematic sectional view showing the change in the conveying position of a paper sheet 100 in a first pattern. In this pattern, the length of the paper sheet 100 is shorter than L1, longer than L0, and longer than L3. The conveying position of the paper sheet 100 is classified into the following cases (1) to (8).

(1) A case when the paper sheet 100 is delivered from the pre-processing device 91 and when the leading end 101 thereof is positioned at the sensor S1 while the trailing end 102 thereof is positioned inside the pre-processing device 91.

The lower conveying rollers 211, 221 and 231 of the first-half conveying path 2A operate at speed V1, the lower conveying rollers 241, 251, 261, 271 and 281 of the last-half conveying path 2B operate at speed V2, the lower conveying rollers 291 of the loading path 2C of the post-processing device 92 also operate at speed V2, the upper conveying rollers 212, 222 and 232 of the first-half conveying path 2A move upward, and the upper conveying rollers 242, 252, 262, 272 and 282 of the last-half conveying path 2B also move upward. Hence, the paper sheet 100 smoothly enters the device 1 from the pre-processing device 91.

(2) A case when the paper sheet 100 is conveyed further and when the leading end 101 thereof is positioned between the sensor S1 and the sensor S2 while the trailing end 102 thereof is positioned inside the pre-processing device 91.

The operation in the above-mentioned case (1) is maintained. Hence, the paper sheet 100 smoothly enters the device 1 from the pre-processing device 91.

(3) A case when the paper sheet 100 is conveyed further and when both the leading end 101 and the trailing end 102 thereof are positioned between the sensor S1 and the sensor S2.

The lower conveying rollers 211 etc. of the first-half conveying path 2A operate at speed V2, the lower conveying rollers 241 etc. of the last-half conveying path 2B and the lower conveying rollers 291 etc. of the loading path 2C of the post-processing device 92 are maintained at speed V2, and the upper conveying rollers 212 etc. of the first-half conveying path 2A and the upper conveying rollers 242 etc. of the last-half conveying path 2B move downward. Hence, the paper sheet 100 is conveyed from the first-half conveying path 2A to the last-half conveying path 2B at speed V2.

(4) A case when the paper sheet 100 is conveyed further and when the leading end 101 thereof is positioned at the sensor S2 while the trailing end 102 thereof is positioned between the sensor S1 and the sensor S2.

The operation in the above-mentioned case (3) is maintained. Hence, the paper sheet 100 is conveyed from the first-half conveying path 2A to the last-half conveying path 2B at speed V2.

(5) A case when the paper sheet 100 is conveyed further and when the leading end 101 thereof is positioned between the sensor S2 and the sensor S3 while the trailing end 102 thereof is positioned between the sensor S1 and the sensor S2.

The operation in the above-mentioned case (3) is maintained. Hence, the paper sheet 100 is conveyed from the first-half conveying path 2A to the last-half conveying path 2B at speed V2.

(6) A case when the paper sheet 100 is conveyed further and when the leading end 101 thereof is positioned at the sensor S3 while the trailing end 102 thereof is positioned between the sensor S2 and the sensor S3.

The lower conveying rollers 211 etc. of the first-half conveying path 2A operate at speed V1, the lower conveying rollers 241 etc. of the last-half conveying path 2B and the lower conveying rollers 291 etc. of the loading path 2C are maintained at speed V2, the upper conveying rollers 212 etc. of the first-half conveying path 2A move upward, and the upper conveying rollers 242 etc. of the last-half conveying path 2B are maintained downward. Hence, the paper sheet 100 is conveyed to the post-processing device 92 at speed V2, and the first-half conveying path 2A prepares for the next paper sheet 100 to be delivered from the pre-processing device 91.

(7) A case when the paper sheet 100 is conveyed further and when the leading end 101 thereof is positioned between the sensor S3 and the sensor S4 while the trailing end 102 thereof is positioned between the sensor S2 and the sensor S3.

The operation in the above-mentioned case (6) is maintained. Hence, the paper sheet 100 is conveyed to the post-processing device 92 at speed V2.

(8) A case when the paper sheet 100 is conveyed further and when the leading end 101 thereof is positioned at the sensor S4 while the trailing end 102 thereof is positioned between the sensor S2 and the sensor S3.

The upper conveying rollers 242 etc. of the last-half conveying path 2B move upward, and the others are maintained as they are. Hence, the last-half conveying path 2B prepares for the next paper sheet 100.

TABLE 1 summarizes the above-mentioned operations.

TABLE 1

| Paper sheet | | | Lower conveying roller | | | Upper conveying roller | |
|---|---|---|---|---|---|---|---|
| Position | Leading end | Trailing end | 2A | 2B | 2C | 2A | 2B |
| (1) | S1 | Device 91 | V1 | V2 | V2 | Upward | Upward |
| (2) | S1~S2 | Device 91 | V1 | V2 | V2 | Upward | Upward |
| (3) | S1~S2 | S1~S2 | V2 | V2 | V2 | Downward | Downward |
| (4) | S2 | S1~S2 | V2 | V2 | V2 | Downward | Downward |
| (5) | S2~S3 | Sl~S2 | V2 | V2 | V2 | Downward | Downward |
| (6) | S3 | S2~S3 | V1 | V2 | V2 | Upward | Downward |
| (7) | S3~S4 | S2~S3 | V1 | V2 | V2 | Upward | Downward |
| (8) | S4 | S2~S3 | V1 | V2 | V2 | Upward | Upward |

As described above, the device 1 can feed the paper sheet 100 received from the pre-processing device 91 at speed V1 to the post-processing device 92 at speed V2. Hence, the post-processing device 92 can perform processing without halting the processing of the pre-processing device 91, whereby the operation efficiency of the system 10 can be improved.

(Second Pattern)

Figure 13:
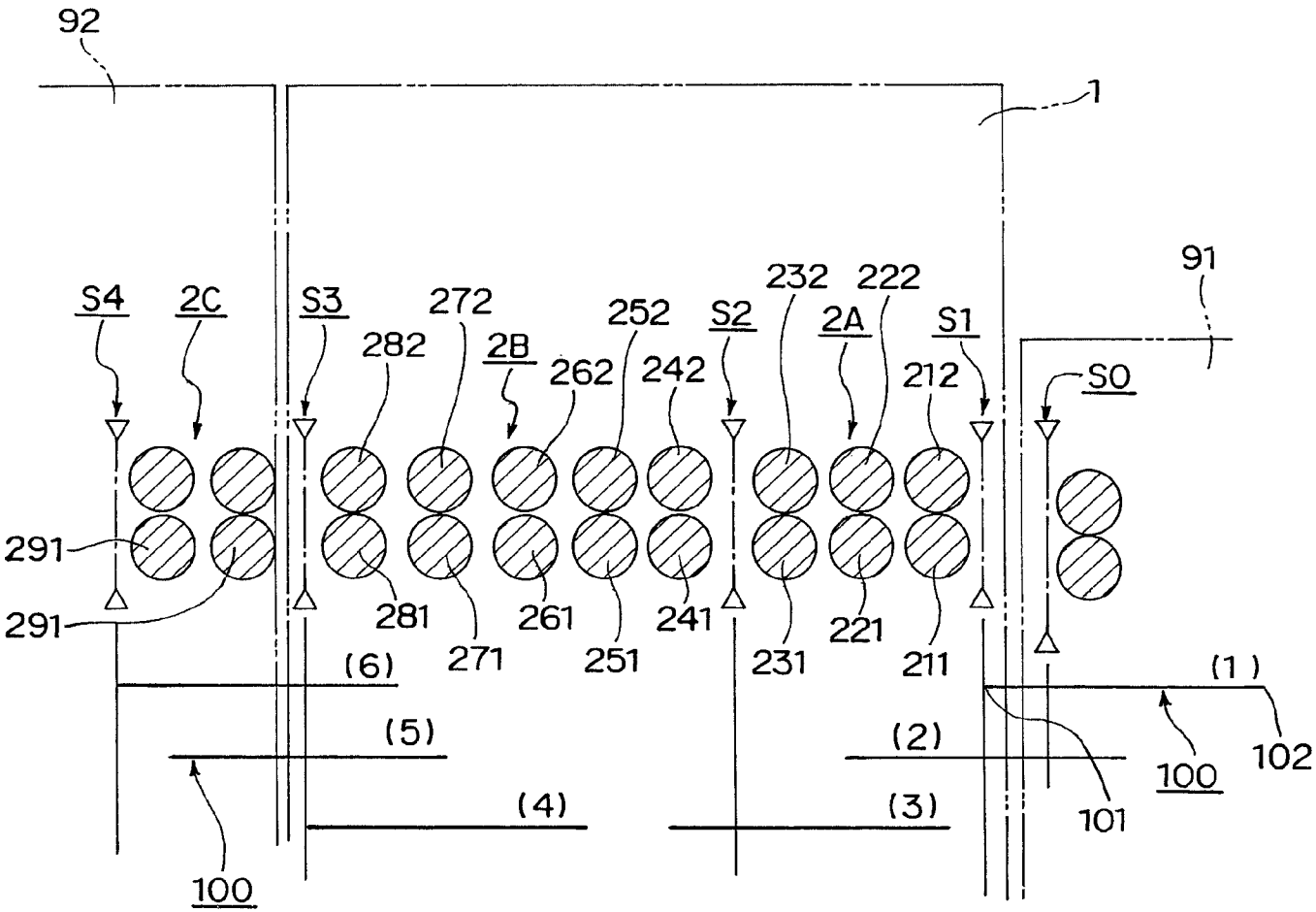
FIG. 13 is a schematic sectional view showing a second pattern of paper sheet conveyance in the system shown in FIG. 11.

FIG. 13 is a schematic sectional view showing the change in the conveying position of the paper sheet 100 in a second pattern. In this pattern, the length of the paper sheet 100 is longer than L0, L1 and L3 and shorter than L2. The conveying position of the paper sheet 100 is classified into the cases (1) to (6) shown in TABLE 2. The operations of the conveying paths 2A, 2B and 2C in the respective cases are shown in TABLE 2.

TABLE 2

| Paper sheet | | | Lower conveying roller | | | Upper conveying roller | |
|---|---|---|---|---|---|---|---|
| Position | Leading end | Trailing end | 2A | 2B | 2C | 2A | 2B |
| (1) | S1 | Device 91 | V1 | V2 | V2 | Upward | Upward |
| (2) | S1~S2 | Device 91 | V1 | V2 | V2 | Upward | Upward |
| (3) | S2~S3 | S1~S2 | V2 | V2 | V2 | Downward | Downward |
| (4) | S3 | S2~S3 | V1 | V2 | V2 | Upward | Downward |
| (5) | S3~S4 | S2~S3 | V1 | V2 | V2 | Upward | Downward |
| (6) | S4 | S2~S3 | V1 | V2 | V2 | Upward | Upward |

Also in this case, the device 1 can feed the paper sheet 100 received from the pre-processing device 91 at speed V1 to the post-processing device 92 at speed V2.

(Third Pattern)

Figure 14:
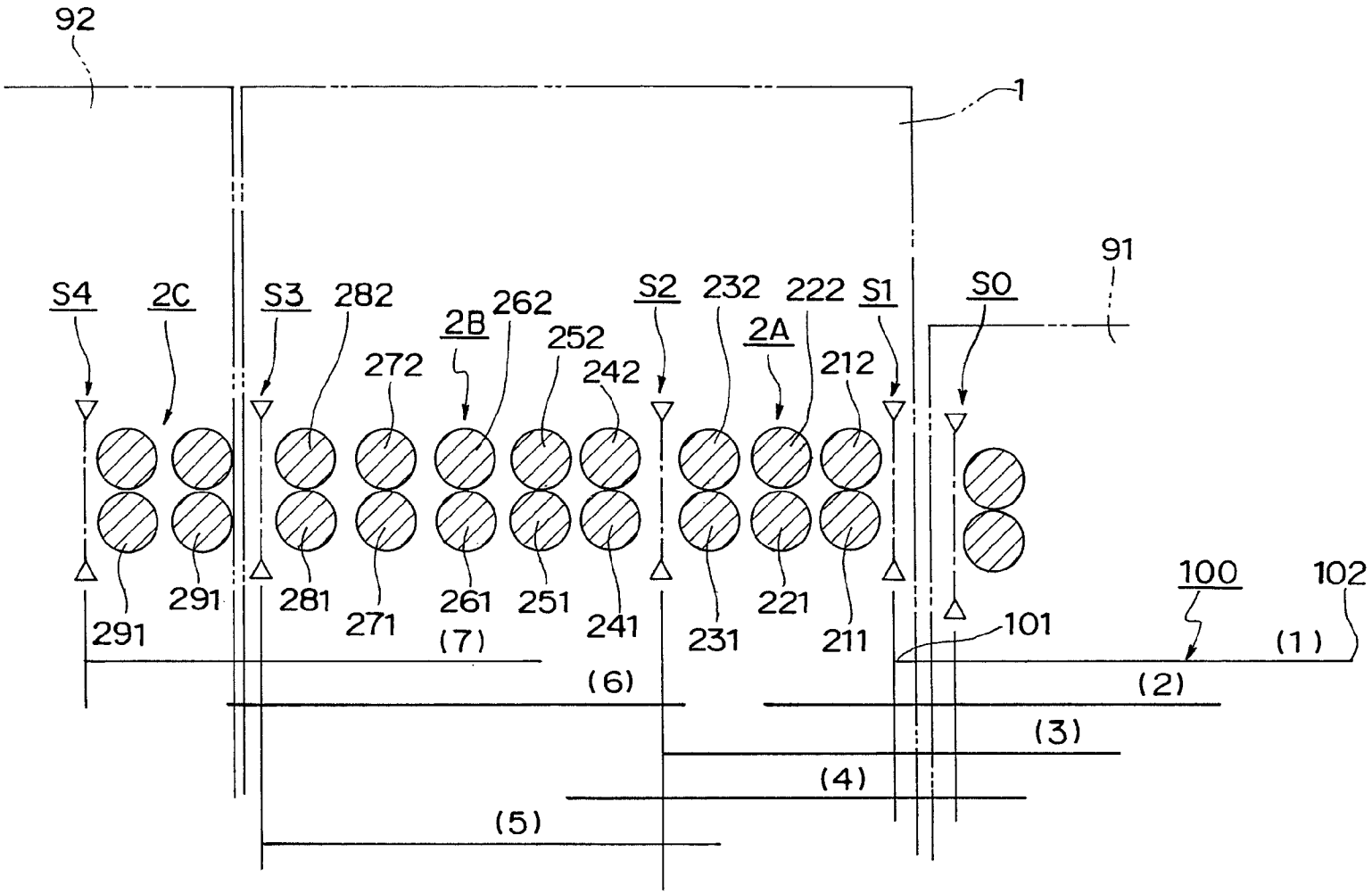
FIG. 14 is a schematic sectional view showing a third pattern of paper sheet conveyance in the system shown in FIG. 11.

FIG. 14 is a schematic sectional view showing the change in the conveying position of the paper sheet 100 in a third pattern. In this pattern, the length of the paper sheet 100 is longer than L2 and shorter than the sum of L1 and L2. The conveying position of the paper sheet 100 is classified into the cases (1) to (7) shown in TABLE 3. The operations of the conveying paths 2A, 2B and 2C in the respective cases are shown in TABLE 3.

TABLE 3

| Paper sheet | | | Lower conveying roller | | | Upper conveying roller | |
|---|---|---|---|---|---|---|---|
| Position | Leading end | Trailing end | 2A | 2B | 2C | 2A | 2B |
| (1) | S1 | Device 91 | V1 | V2 | V2 | Upward | Upward |
| (2) | S1~S2 | Device 91 | V1 | V2 | V2 | Upward | Upward |
| (3) | S2 | Device 91 | V1 | V2 | V2 | Upward | Upward |
| (4) | S2~S3 | Device 91 | V1 | V1 | V2 | Upward | Upward |
| (5) | S3 | S1~S2 | V2 | V2 | V2 | Downward | Downward |
| (6) | S3~S4 | S1~S2 | V2 | V2 | V2 | Downward | Downward |
| (7) | S4 | S2~S3 | V1 | V2 | V2 | Upward | Upward |

Also in this case, the device 1 can feed the paper sheet 100 received from the pre-processing device 91 at speed V1 to the post-processing device 92 at speed V2.

(Fourth Pattern)

Figure 15:
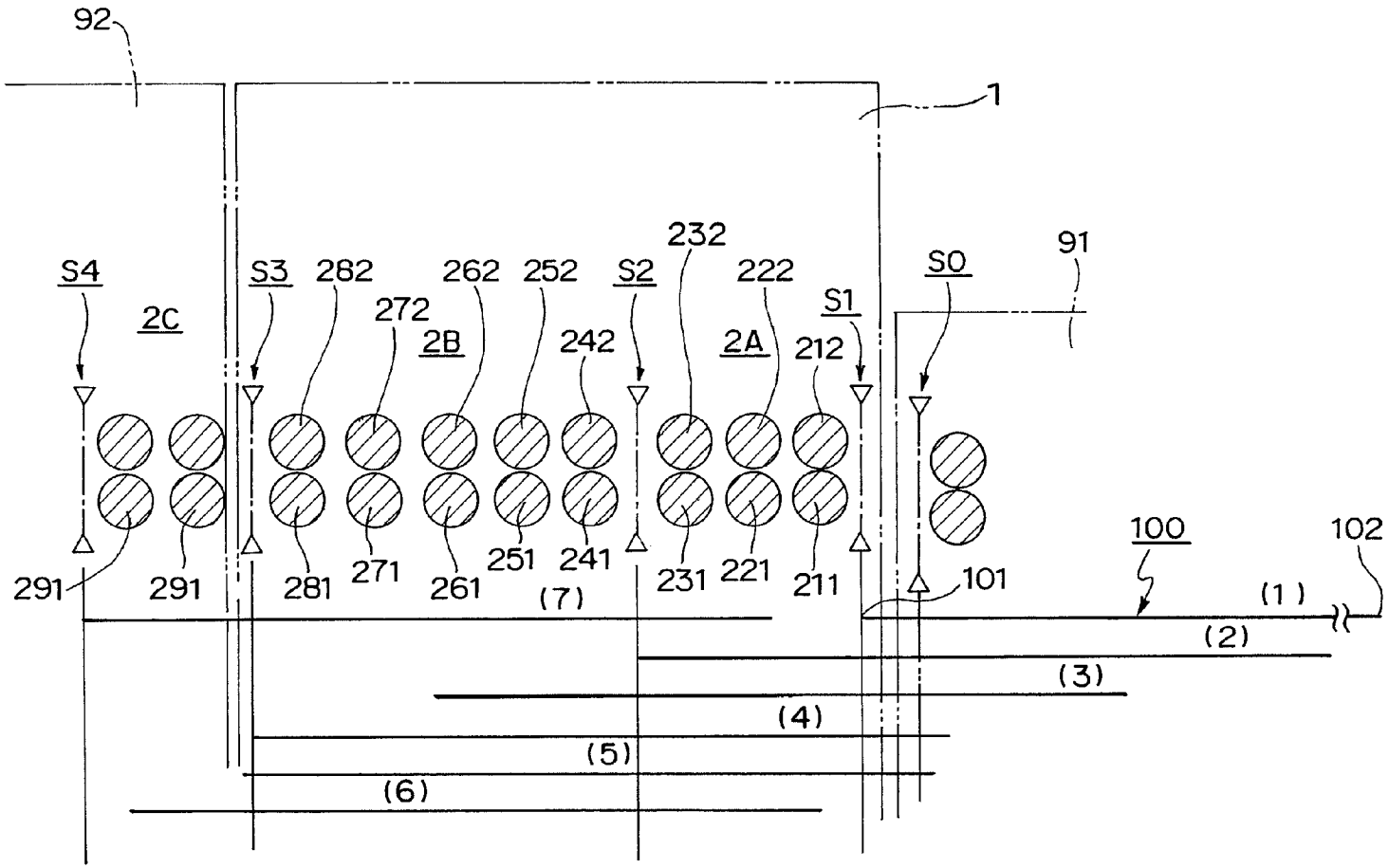
FIG. 15 is a schematic sectional view showing a fourth pattern of paper sheet conveyance in the system shown in FIG. 11.

FIG. 15 is a schematic sectional view showing the change in the conveying position of the paper sheet 100 in a fourth pattern. In this pattern, the length of the paper sheet 100 is longer than the sum of L1 and L2. The conveying position of the paper sheet 100 is classified into the cases (1) to (7) shown in TABLE 4. The operations of the conveying paths 2A, 2B and 2C in the respective cases are shown in TABLE 4.

TABLE 4

| Paper sheet | | | Lower conveying roller | | | Upper conveying roller | |
|---|---|---|---|---|---|---|---|
| Position | Leading end | Trailing end | 2A | 2B | 2C | 2A | 2B |
| (1) | S1 | Device 91 | V1 | V2 | V2 | Upward | Upward |
| (2) | S2 | Device 91 | V1 | V2 | V2 | Upward | Upward |
| (3) | S2~S3 | Device 91 | V1 | V1 | V2 | Upward | Upward |
| (4) | S3 | Device 91 | V1 | V1 | V2 | Upward | Upward |
| (5) | S3~S4 | Device 91 | V1 | V1 | V1 | Upward | Upward |
| (6) | S3~S4 | S1~S2 | V2 | V2 | V2 | Downward | Downward |
| (7) | S4 | S1~S2 | V2 | V2 | V2 | Upward | Upward |

Also in this case, the device 1 can feed the paper sheet 100 received from the pre-processing device 91 at speed V1 to the post-processing device 92 at speed V2.

(Another Pattern)

In the case of conveying the paper sheet 100 not conforming to the above-mentioned first to fourth patterns, the corresponding position thereof is selected from among the respective positions of the paper sheet shown in TABLE 5, and the operations of the lower conveying rollers and the upper conveying rollers shown at the position are performed.

TABLE 5

| Paper sheet | | | Lower conveying roller | | | Upper conveying roller | |
|---|---|---|---|---|---|---|---|
| Position | Leading end | Trailing end | 2A | 2B | 2C | 2A | 2B |
| (1) | S1 | Device 91 | V1 | V2 | V2 | Upward | Upward |
| (2) | S1~S2 | Device 91 | V1 | V2 | V2 | Upward | Upward |
| (3) | S1~S2 | S1~S2 | V2 | V2 | V2 | Downward | Downward |
| (4) | S2 | Device 91 | V1 | V2 | V2 | Upward | Upward |
| (5) | S2 | S1~S2 | V2 | V2 | V2 | Downward | Downward |
| (6) | S2~S3 | Device 91 | V1 | V1 | V2 | Upward | Upward |
| (7) | S2~S3 | S1~S2 | V2 | V2 | V2 | Downward | Downward |
| (8) | S3 | Device 91 | V1 | V1 | V2 | Upward | Upward |
| (9) | S3 | S1~S2 | V2 | V2 | V2 | Downward | Downward |
| (10) | S3 | S2~S3 | V1 | V2 | V2 | Upward | Downward |
| (11) | S3~S4 | Device 91 | V1 | V1 | V1 | Upward | Upward |
| (12) | S3~S4 | S1~S2 | V2 | V2 | V2 | Downward | Downward |
| (13) | S3~S4 | S2~S3 | V1 | V2 | V2 | Upward | Downward |
| (14) | S4 | Device 91 | V1 | V1 | V1 | Upward | Upward |
| (15) | S4 | S1~S2 | V2 | V2 | V2 | Upward | Upward |
| (16) | S4 | S2~S3 | V1 | V2 | V2 | Upward | Upward |

Also in this case, the device 1 can feed the paper sheet 100 received from the pre-processing device 91 at speed V1 to the post-processing device 92 at speed V2.

[Other Embodiments of the Paper Sheet Conveying System]

Figure 16:
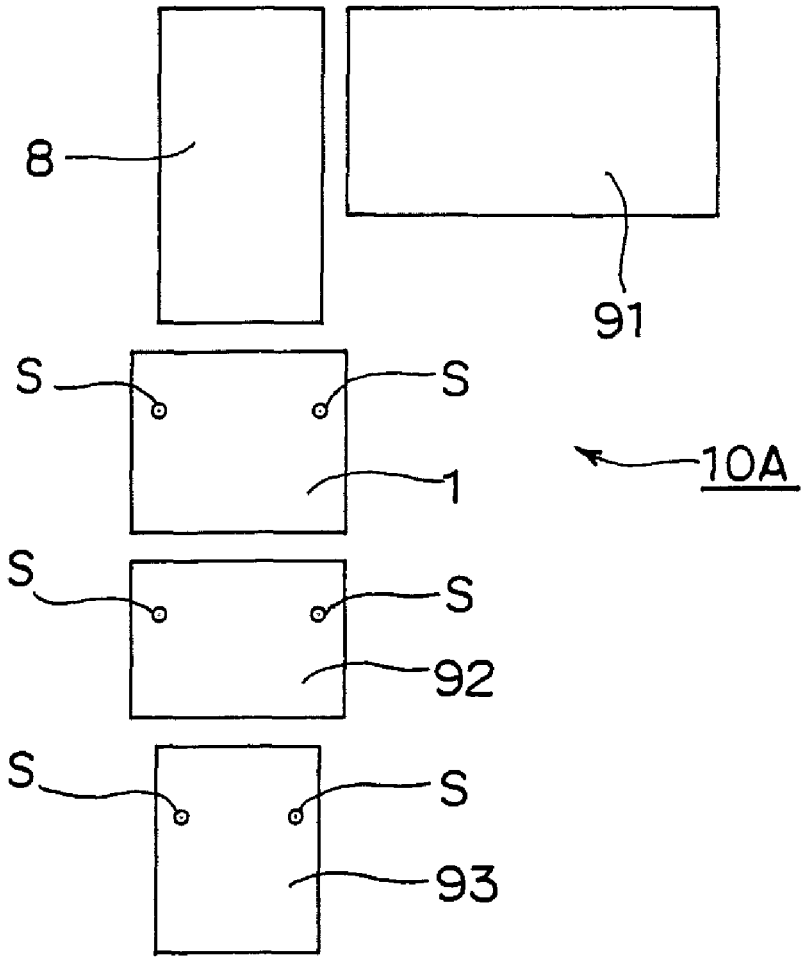
FIG. 16 is a plan view showing the configuration of a paper sheet conveying system according to another embodiment of the present invention.

FIG. 16 is a schematic plan view showing a paper sheet conveying system 10A being configured that a cross conveying device 8 is disposed on the downstream side of the pre-processing device 91 and that the paper sheet conveying device 1, the post-processing device 92 and the stacker device 93 are arranged in this order on the downstream side thereof.

Figure 17:
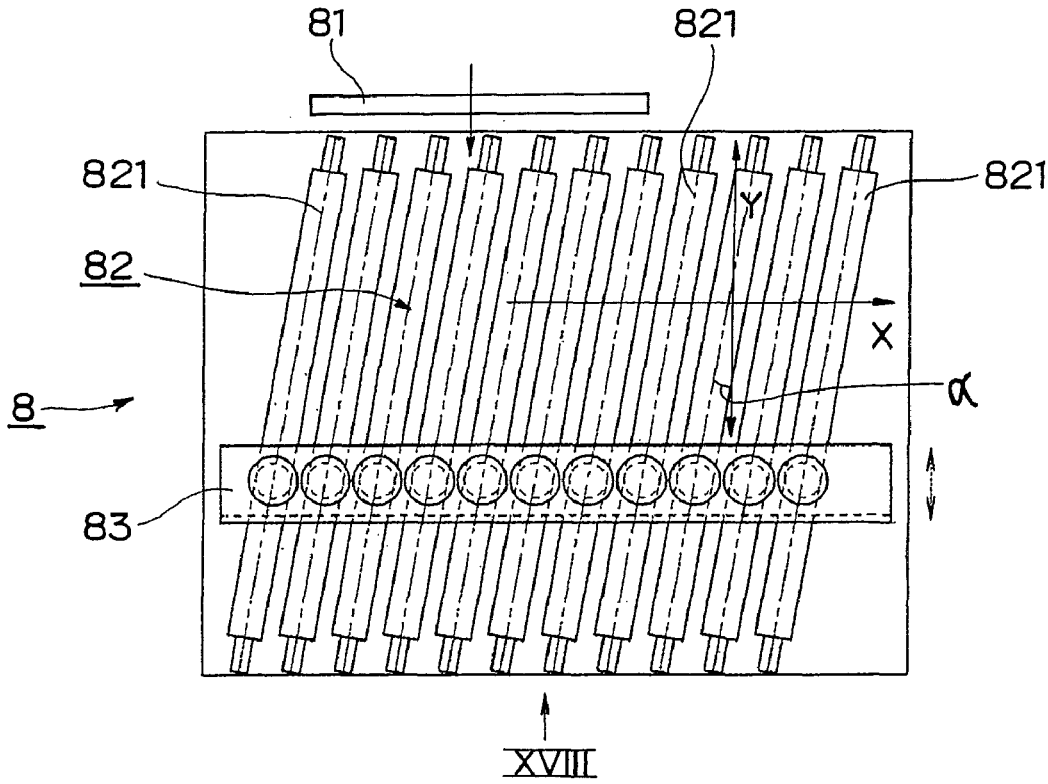
FIG. 17 is a plan view showing a cross conveying device.
Figure 18:
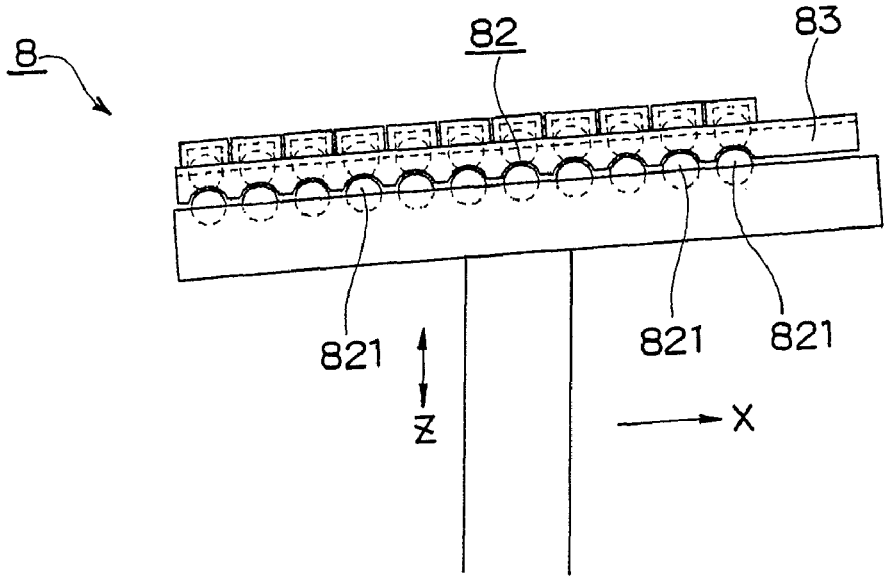
FIG. 18 is a view seen from arrow XVIII of FIG. 17.

FIG. 17 is a plan view showing the cross conveying device 8, and FIG. 18 is a view seen from arrow XVIII of FIG. 17. The cross conveying device 8 is equipped with a delivery roller 81, a conveying path 82 and a guide 83. The delivery roller 81 is formed of a pair of upper and lower rollers to hold the paper sheet fed from the preceding stage and to deliver the paper sheet onto the conveying path 82 (in the arrow direction). The conveying path 82 is formed of a large number of conveying rollers 821 arranged in parallel. All the conveying rollers 821 are disposed so as to be tilted by angle $\alpha$ with respect to the direction (the arrow Y direction) orthogonal to the conveying direction (the arrow X direction). The guide 83 extends along the conveying direction (the arrow X direction). Hence, the paper sheet delivered from the delivery roller 81 is conveyed in the conveying direction while being pushed toward the guide 83. Since the guide 83 is set at a predetermined position, the paper sheet is conveyed along the left side in the width direction. In other words, the cross conveying device 8 conveys the paper sheet in the direction orthogonal to the delivery direction of the delivery roller 81 along the left side in the width direction. Furthermore, the conveying path 82 is tilted so as to rise toward the downstream side in the conveying direction as shown in FIG. 18. Moreover, the cross conveying device 8 is equipped with a height adjustment mechanism for adjusting the height position of the conveying path 82, whereby the conveying path 82 can be adjusted in height in the direction indicated by arrow Z while being tilted.

Furthermore, conventionally, the paper sheet conveying device 1, the post-processing device 92 and the stacker device 93, positioned on the downstream side of the cross conveying device 8, are respectively equipped with sensors for detecting the position of the paper sheet; in the system 10A, these devices are respectively equipped with sensors S on both sides in the width direction thereof as shown in FIG. 16.

Generally speaking, the height positions of the conveying paths in the respective devices constituting a paper sheet conveying system are different from one another. However, in the system 10A having the above-mentioned configuration, the cross conveying device 8 having the conveying path 82 that is tilted and adjustable in height is disposed between the pre-processing device 91 and the paper sheet conveying device 1, whereby the two devices 91 and 1 can be connected without problems.

Furthermore, generally speaking, in the respective devices constituting a paper sheet conveying system, a paper sheet is conveyed along the right side of the conveying path, and sensors for detecting the position of the paper sheet is also disposed on the right side of the conveying path. Hence, in the case that the cross conveying device 8 is disposed in the middle of the system, the paper sheet is conveyed along the left side in the respective devices on the downstream side therefrom, whereby it is difficult to detect the position of the paper sheet by using the sensors. However, in the system 10A having the above-mentioned configuration, since the respective devices on the downstream side from the cross conveying device 8 are equipped with the sensors S on both sides in the width direction, the position of the paper sheet can be detected by using the sensors S even if the paper sheet is conveyed along the left side.

Figure 19:
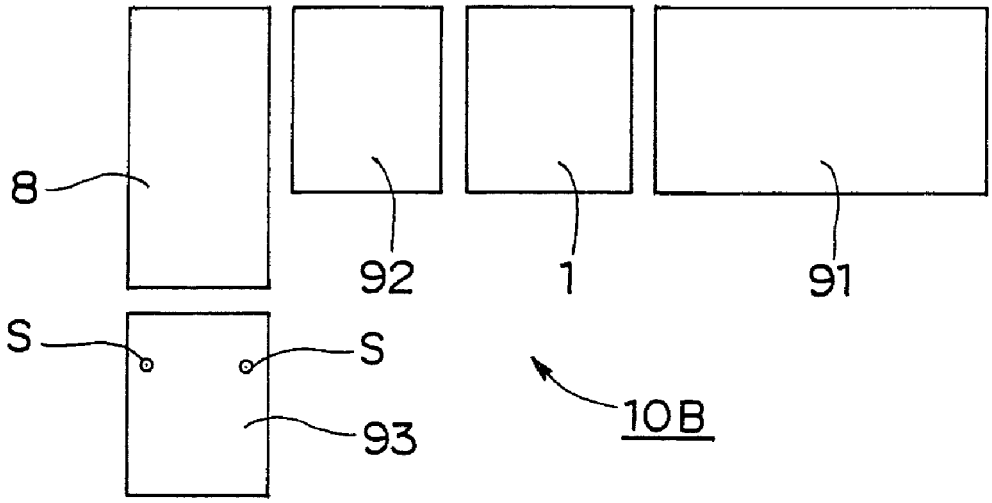
FIG. 19 is a plan view showing the configuration of a paper sheet conveying system according to still another embodiment of the present invention.

The cross conveying device 8 may be disposed between the paper sheet conveying device 1 and the post-processing device 92 or may be disposed between the post-processing device 92 and the stacker device 93 as in the case of a paper sheet conveying system 10B shown in FIG. 19.

INDUSTRIAL APPLICABILITY

Since the paper sheet conveying device according to the present invention can receive a paper sheet in synchronization with the conveying speed of the pre-processing device and deliver the paper sheet in synchronization with the conveying speed of the post-processing device, the invention is high in industrial applicability.

The invention claimed is:

1. A paper sheet conveying device for conveying a paper sheet delivered from a pre-processing device to a post-processing device, comprising:

a conveying path formed of at least four pairs of integrally operating conveying roller pairs arranged in parallel, each pair consisting of upper and lower conveying rollers for conveying a paper sheet held therebetween, and a controlling section for detecting the position of the paper sheet being conveyed and controlling the operation of said conveying rollers, wherein said conveying path is composed of a first-half conveying path formed of a plurality of the integrally operating conveying roller pairs and a last-half conveying path formed of a plurality of the integrally operating conveying roller pairs, said first-half conveying path has a first-half driving mechanism for controlling the rotational speed of the lower conveying rollers of said integrally operating conveying roller pairs of the first-half conveying path and a first-half vertically moving mechanism for vertically moving the upper conveying rollers of said integrally operating conveying roller pairs of the first-half conveying path, said last-half conveying path has a last-half driving mechanism for controlling the rotational speed of the lower conveying rollers of said integrally operating conveying roller pairs of the last-half conveying path and a last-half vertically moving mechanism for vertically moving the upper conveying rollers of said integrally operating conveying roller pairs of the last-half conveying path, and said controlling section is configured so as to control said first-half driving mechanism, said first-half vertically moving mechanism, said last-half driving mechanism and said last-half vertically moving mechanism depending on the position of the paper sheet being conveyed.

2. The paper sheet conveying device according to claim 1, wherein said controlling section is configured so as to:

control said first-half vertically moving mechanism and said last-half vertically moving mechanism so as to move said upper conveying rollers of said first-half conveying path and said last-half conveying path upward when the trailing end of a paper sheet being delivered from said pre-processing device is within said pre-processing device, control at least said first-half driving mechanism so that the rotational speed of at least said lower conveying rollers of said first-half conveying path becomes equal to the conveying speed of said pre-processing device, control said first-half vertically moving mechanism and said last-half vertically moving mechanism so as to move said upper conveying rollers of said first-half conveying path and said last-half conveying path downward at the time when the trailing end of the paper sheet is approximately moved away from said pre-processing device, and control said first-half driving mechanism and said last-half driving mechanism so that the rotational speed of said lower conveying rollers of said first-half conveying path and said last-half conveying path becomes equal to the conveying speed of said post-processing device.

3. The paper sheet conveying device according to claim 1, wherein said controlling section is equipped with detection sections for detecting the position of the paper sheet being conveyed at the leading end of said first-half conveying path, between said first-half conveying path and said last-half conveying path, and at the trailing end of said last-half conveying path.

4. A paper sheet conveying system in which a pre-processing device for performing a cutting process or a creasing process for a paper sheet while conveying the paper sheet, said paper sheet conveying device according to claim 1, and a post-processing device for performing a folding process for the paper sheet while conveying the paper sheet are connected in this order.

5. The paper sheet conveying system according to claim 4, wherein said controlling section of said paper sheet conveying device is equipped with detection sections for detecting the position of the paper sheet being conveyed at the trailing end of said pre-processing device, at the leading end of said first-half conveying path, between said first-half conveying path and said last-half conveying path, at the trailing end of said last-half conveying path, and at the trailing end of the loading path of said post-processing device.

6. The paper sheet conveying system according to claim 4, wherein a cross conveying device for conveying the delivered paper sheet in the direction orthogonal to the delivery direction along one side in the width direction is disposed between said pre-processing device and said paper sheet conveying device or between said paper sheet conveying device and said post-processing device, said cross conveying device is equipped with a conveying path tilted so as to rise from the upstream side toward the downstream side in the conveying direction and a height adjustment mechanism for adjusting the height position of said conveying path.

7. The paper sheet conveying system according to claim 6, wherein said paper sheet conveying device or said post-processing device disposed on the downstream side of said cross conveying device has detection sections for detecting the position of the paper sheet on both the sides in the width direction of said conveying path for conveying the paper sheet.

8. A paper sheet conveying system in which a pre-processing device for performing a cutting process and a creasing process for a paper sheet while conveying the paper sheet, said paper sheet conveying device according to claim 1, and a post-processing device for performing a folding process for the paper sheet while conveying the paper sheet are connected in this order.

9. The paper sheet conveying system according to claim 4, wherein a cross conveying device for conveying the delivered paper sheet in the direction orthogonal to the delivery direction along one side in the width direction is disposed between said pre-processing device and said paper sheet conveying device and between said paper sheet conveying device and said post-processing device, said cross conveying device is equipped with a conveying path tilted so as to rise from the upstream side toward the downstream side in the conveying direction and a height adjustment mechanism for adjusting the height position of said conveying path.

* * * * *